US005624114A

United States Patent [19]

Kelsey

[11] Patent Number: 5,624,114

[45] Date of Patent: Apr. 29, 1997

[54] BALL BAT SHOCK DAMPER

[76] Inventor: Douglas A. Kelsey, P.O. Box 1534, Alvarado, Ariz. 76009

[21] Appl. No.: 505,133

[22] Filed: Jul. 21, 1995

Related U.S. Application Data

[63] Continuation of Ser. No. 189,458, Jan. 31, 1994, abandoned, which is a continuation-in-part of Ser. No. 11,531, Aug. 6, 1993, abandoned.

[51] Int. Cl.[6] ..... A63B 59/06

[52] U.S. Cl. ..... 473/520; 473/457; 473/564

[58] Field of Search ..... 273/72 R, 72 A, 273/67 R, 26 B, 26 R

[56] References Cited

U.S. PATENT DOCUMENTS

| | | | |
|---|---|---|---|
| 979,266 | 12/1910 | Dean | 273/72 R |
| 2,091,458 | 8/1937 | Sleight | 273/72 R |
| 2,659,605 | 11/1953 | Tourneau | 273/72 R |
| 2,984,486 | 5/1961 | Jones | 273/72 R |
| 3,469,839 | 9/1969 | Pietronuto et al. | 273/25 |
| 3,703,290 | 11/1972 | Wilson | 273/72 A |
| 3,735,473 | 5/1973 | Wilson | 29/421 |
| 3,779,551 | 12/1973 | Wilson | 273/72 A |
| 4,248,425 | 2/1981 | Easton et al. | 273/72 A |

OTHER PUBLICATIONS

"Voit" Catalog, Jul. 1953, p. 22.

*Primary Examiner*—Mark S. Graham
*Attorney, Agent, or Firm*—Oney Law Firm

[57] ABSTRACT

A resiliently compressible and stretchable sleeve has an opening at one end adapted to closely fit around a handle of a ball bat, and an interior adapted to closely fit around an enlarged end knob which terminates at the handle. The sleeve is positioned to cover the end knob to cushion the batter's hand from vibrations in the end knob and the sleeve can be readily removed from and replaced on the bat. One or more sleeves, each having a hole extending completely through it, can be positioned on the handle of the bat to provide a reference for gripping the handle away from the end knob.

9 Claims, 1 Drawing Sheet

BALL BAT SHOCK DAMPER

CROSS-REFERENCE TO RELATED APPLICATION

This is a continuation of application Ser. No. 08/189,458, filed Jan. 31, 1994, abandoned, which is a continuation-in-part of application Ser. No. 29/011,531, filed Aug. 6, 1993, now abandoned.

BACKGROUND

My invention relates to ball bats and similar implements. More specifically, it relates to a shock damper that can be quickly and easily attached to the end knob of a ball bat or similar implement to reduce the transmission of vibrations from the end knob to the users hands, to provide the user with an improved grip on the bat and to provide a reference for the user to grip the bat.

The familiar form of a baseball bat has a generally cylindrical, relatively large barrel portion at one end and a generally cylindrical, relatively small handle portion at the other end. The handle is terminated by an end knob or ring-like enlargement, which helps to prevent the handle from flying out of the batter's hand when the bat is swung. For improving gripping characteristics of handles of hollow bat structures, at least a portion of the handle has a grip, usually made of a wrap of leather or similar material or a thin sleeve of synthetic material which terminates at a point on the handle near the end knob. For baseball bats turned from wood stock, the end knob is formed as an integral enlargement at the end of the handle. For hollow bat structures of metal or other suitable materials, the end knob is formed with a plug or extension joined to the end of the handle. Such a plug or extension must have sufficient structural rigidity to maintain an effective connection with the handle of the bat and to withstand the severe mechanical shock and axial stress to which the end knob is subjected during normal use of the bat.

When a ball bat is submitted to an impact, like the striking of a ball, the bat vibrates. Whether the bat is wooden or is of hollow construction of metal or other materials, if the ball strikes the bat away from the center of the barrel, these vibrations can be relatively intense and cause an unpleasant, and sometimes even painful, sensation in the batter's hands often referred to as "bat sting." Some of the more unpleasant and painful of these vibrations are often transmitted through the end knob of the bat to the heel of the player's hand resting against the end knob as the player grips the handle. Moreover, end knobs with exteriors made of hard materials, such as wood or metal, make it more difficult for a batter to keep a good grip on the bat.

Over the years, some ball players have wrapped tape over the end knobs of ball bats to attempt to reduce bat sting and to improve their grip. However, tape is inconvenient to apply and remove and is relatively ineffective in reducing bat sting.

For bats of hollow metal construction, metal end caps have long been known, but failed to provide desired vibration dampening characteristics. See U.S. Pat. No. 3,703,290 (Nov. 21, 1972) to Wilson. A number of United States patents have disclosed bat end knobs composed of rubberous or homogeneous resiliently compressive material adapted to dampen vibrations in hollow bats. See U.S. Pat. No. 3,735,473 (Feb. 3, 1981) to Wilson. As noted above, however, such end plugs must have structural rigidity, which limits their vibration dampening capabilities.

U.S. Pat. No. 3,703,290 discloses a hollow metal ball bat construction using a composite knob end plug having an inner plug element composed of substantially rigid material and a partially exposed outer plug element composed of resiliently compressible material such as plastic or rubber, with polyvinyl chloride being preferred. As noted by Wilson, the dampening characteristics are improved as the outer plug element is made more compressible, but this tends to worsen wear resistance of the end knob.

Notwithstanding the previously known end knob constructions using resiliently compressible material, most hollow bats sold today have end knobs with a metal exterior used to form a secure mechanical joint with the handle of the bat. U.S. Pat. No. 4,248,425 (Feb. 3, 1981) to Easton et al. discloses a hollow bat structure having such an end knob. The end knob has a rigid exterior "skin" and an interior cavity. Positioned in the cavity is a compressed ring of resilient material, such as gum, plastic or rubber, for vibration dampening. Again, however, because the exterior of the end knob is rigid and is securely joined to the bat handle, the reduction of vibrations transmitted to the batter's hand from the end knob is not optimal. Moreover, it is more difficult for a batter to effectively grip such an end knob because it has a rigid exterior.

None of the end knobs described above can be quickly and easily removed from and replaced on the bat, for example, when the end knob is worn or damaged. Moreover, to the extent these end knob constructions provide vibration dampening, they do not apply to bats of solid wooden construction.

In addition to the above needs, it is sometimes desirable for a batter to "choke up" in gripping the handle of a bat so that the heel of the batter's lower hand is located on the handle some distance above the end knob of the bat. For example, a batter will often choke up to exercise better bat control during the batter's swing. To help train batters (particularly those who are young or are just learning how to bat) to choke up on the bat handle, it is desirable to provide a device to give the batter a reference point for locating his or her grip.

There remains, therefore, a need for a ball bat shock damper that provides improved vibration dampening and improved gripping characteristics and that can be quickly and easily placed on and removed from the bat. In addition, there is a need for a reference device for gripping a bat that provides vibration dampening and is easy to use.

SUMMARY

My invention is directed to a ball bat or similar implement having a shock damper that satisfies the needs described above. A shock damper having features of my invention includes a sleeve that is resiliently deformable so that it can be compressed and stretched. The sleeve has an opening at one end that will closely fit around the handle of the bat. The interior of the sleeve is adapted to closely fit over the end knob of the bat. Because the sleeve is resiliently compressible, it has vibration dampening characteristics and forms a cushion over the end knob of the bat to protect the batter's hand and to provide the batter with a better grip on the end knob. Because the sleeve is resiliently stretchable, it can be easily placed over the end knob of the bat by stretching the sleeve enough to enlarge the opening to slide the sleeve over the enlarged end knob and into a position covering all or part of the end knob. The sleeve can be easily removed by stretching it to enlarge the opening and sliding the sleeve away from the handle, past the end knob and off the bat.

In one form of my invention, the sleeve has a generally cylindrical shape with a hole extending through the length of the sleeve. The hole has dimensions so that the sleeve will closely fit the end knob. At one end of the sleeve there is a first opening that will closely fit around the handle of the bat adjacent to the end knob. At the other end there is a second opening that has a diameter smaller than the cross section of the end knob. When the sleeve is in position over the end knob it covers the end knob except for a portion of the end knob's end surface, which is exposed through the second opening. Because the second opening is smaller than the cross section of the end knob, the sleeve will not inadvertently slide off the end knob toward the handle. However, because the sleeve is stretchable, it can be stretched to slide it past the end knob and around the handle. By "stacking" one or more sleeves on the bat handle in this fashion, one can provide a batter with a reference to "choke-up" on the handle.

The sleeve is composed of resiliently deformable material such as rubber or plastic material. Suitable materials for use in the sleeve include plastics manufactured from a copolymer such as that sold by Shell Oil under the trademark "KRATON" and such as polyvinylchloride, with the KRATON-based copolymer being preferred. Such plastics can be conveniently molded to form a sleeve that has the desired vibration dampening characteristics and improved gripping characteristics and is sufficiently stretchable to remove the sleeve from and replace it on the end knob and handle of the bat.

One object of my invention is to provide a shock damper to reduce vibrations transmitted through the end knob of a ball bat or similar implement to the user's hands.

Another object of my invention is to provide a shock damper that also has improved gripping characteristics.

Another object of my invention is to provide such a shock damper that is suitable for ball bats or similar implements regardless of whether the bat is of solid wooden construction, hollow construction or any other suitable bat construction.

Another object of my invention is to provide a shock damper that one can quickly and easily place on the bat and remove and replace.

Another object of my invention is to provide a shock damper which can be used as a means for providing a reference for a batter to choke up in gripping the ball bat.

Still another object of my invention is to provide a shock damper which helps protect the end knob of the bat from damage.

These and other objects and advantages of the invention will be more fully understood from the following more detailed description in conjunction with the accompanying drawings, in which:

DESCRIPTION

Figure 1:
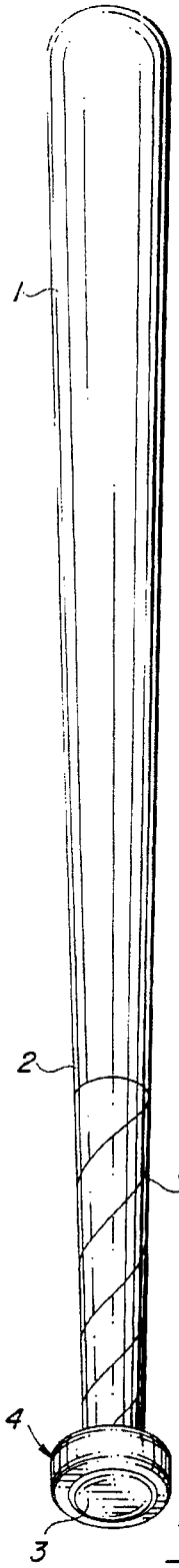
FIG. 1 is a perspective view of a form of ball bat having a sleeve positioned over the end knob, which embodies features of my invention.

For purposes of promoting a better understanding of the invention, reference will now be made to the embodiments illustrated in the drawings and specific language will be used to describe these embodiments. It will nevertheless be understood that no limitation of the scope of the invention is thereby intended. Alterations and modifications of the illustrated device are contemplated, as are such further applications of the principles of the invention as would normally occur to one skilled in the art to which the invention pertains.

The term "generally cylindrical," as used herein to refer to barrel or handle portions of bats, shall include bat portions provided with a taper such as might be found in bats which are continuously or partially tapered. The term "generally cylindrical" as used herein to refer to the shape of a sleeve shall include shapes with a tapered perimeter surface, such as a frustum. The term "sleeve" as used herein shall include a structure with a hole having an opening at each end of the structure, such as a tube.

In accordance with my invention, FIG. 1 shows a ball bat of a familiar shape comprising a generally-cylindrical barrel 1 on one end and a generally-cylindrical handle 2 on the other end terminating in an enlarged end knob 3. A portion of the handle 2 is covered by a grip 5, which can be made of leather or suitable synthetic material. The bat may be of solid wooden construction, of hollow construction using metal or other suitable materials, or of any other suitable construction. A sleeve 4, is shown in place over the end knob 3 of the bat. The sleeve is made of resiliently deformable material adapted to protect the batter's hand from shock and vibrations and to provide improved gripping characteristics.

Figure 3:
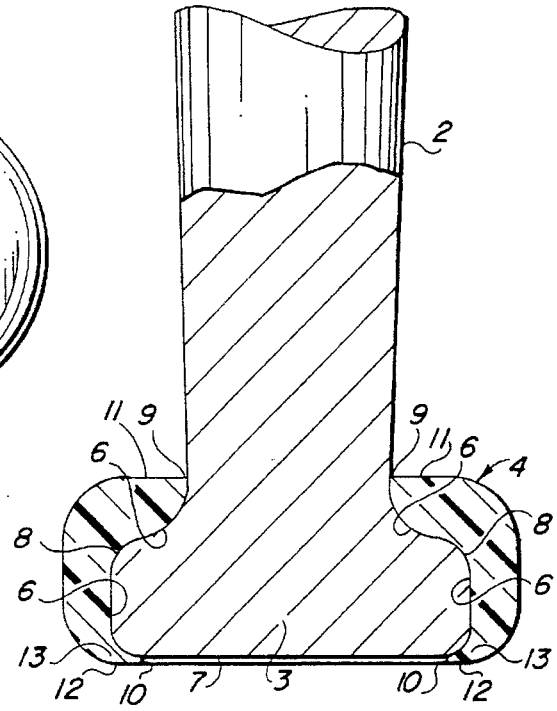
FIG. 3 is an elevation view with a partial section taken through line 3—3 of FIG. 2 showing the sleeve structure and placement on the bat.

Referring to FIG. 3, which shows a preferred embodiment of the invention, the end knob 3 has a transverse cross section larger than that of the handle 2 and forms a ring-like enlargement which serves to prevent the bat from flying out of the batter's hand during use. The shape of the end knob 3 is defined by an annular surface 6, which extends from the base of the handle 2 to a a generally flat, transverse end surface 7. The sleeve 4 has a first opening 9 at one end adapted to fit closely around the handle 2. The interior of the sleeve 4 defines a hole 8 adapted to closely fit over the annular surface 6 of the end knob 3. The sleeve 4 may be permanently secured to the end knob 3, for example, with adhesive. It is preferable not to do so, however, so that the sleeve 4 may be readily removed from and replaced on the bat. Preferably, the sleeve 4 is adapted to also closely fit over at least a portion of the end surface 7 to help restrict the sleeve from inadvertently sliding off the end knob 3 towards the bat handle 2.

The sleeve 4 is composed, at least in part, of material that is resilient, to retain its shape, and compressible to provide shock dampening characteristics, such as plastic or rubber. Because the sleeve 4 is not required to provide structural rigidity to the end knob 3, the material can be selected to provide optimal vibration dampening characteristics. Preferably, the sleeve 4 is sufficiently resilient to permit it to be stretched as required to remove it from the bat and to replace it on the bat as described in more detail below. Suitable materials for these purposes include polyvinylchloride, silicon rubber and elastomers manufactured from a styrene-ethelyne/butylene-styrene block copolymer, such as that sold by Shell Oil Company under the trademark "KRATON." For desirable vibration dampening characteristics, it is preferable that the sleeve 4 be composed of material having a hardness of from 20 to 30 on the Shore A scale. Harder material, such as material having a hardness of about 50 on the Shore A scale, will provide some vibration dampening and may be used. However, a sleeve 4 made of such material does not have optimal stretchability for placing it on and removing it from the bat and does not provide optimal dampening of end knob vibrations.

Referring again to FIGS. 3 and 4, the illustrated embodiment of my invention is used as I now describe. When in place over the end knob 3, the sleeve 4 acts as a cushioning device to protect the batter's hand as it rests against the sleeve 4. To place the sleeve 4 in position on the bat, the user stretches the sleeve 4 to elastically enlarge the first opening 9 and the hole 8 enough to slide the sleeve 4 over the end knob 3 in a direction toward the handle 2 of the bat and into the position on the end knob 3, as shown in FIG. 3. To remove the sleeve 4, the user simply reverses this process, stretching the sleeve 4 to elastically enlarge the first opening 9 and the hole 8 enough to slide the sleeve 4 in a direction away from the handle 2 and over and past the end knob 3.

Figure 5:
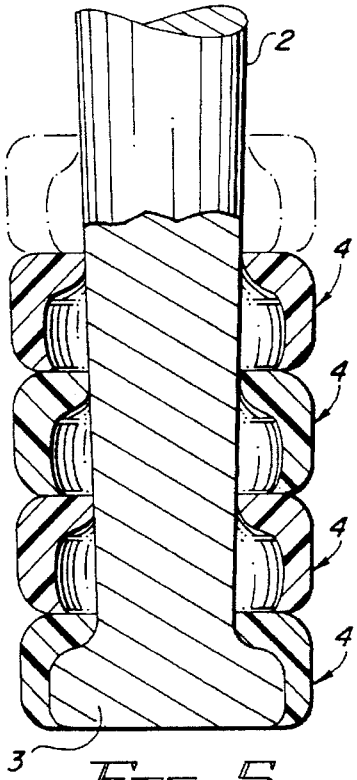
FIG. 5 is an elevation view with a partial section taken through the longitudinal axis of the bat handle, showing another alternative embodiment of the invention, which embodiment has multiple sleeves of the type shown in FIG. 3.

Referring to FIG. 5, a plurality of sleeves 4 may be used to provide an adjustable means for providing a reference to assist in locating the batter's grip on the bat handle 2 away from the end knob 3. The sleeves 4 shown in FIG. 5 are of the form shown in FIG. 3. Referring to FIG. 3, the hole 8 extends through the entire length of the sleeve 4. Because each sleeve 4 is stretchable, it can be stretched to slide past the end knob and around the handle 2. One or more sleeves 4 can be placed on the bat handle 3 in this fashion in stacked relationship to the end knob, as shown in FIG. 5. Preferably, one sleeve 4, is also positioned around the end knob 3 of the bat as described with respect to FIG. 3. This configuration provides the batter with a reference for gripping the bat, which reference can be easily adjusted by varying the number of sleeves 4 placed on the bat handle 2.

The previously described embodiment of the present invention has many advantages. By providing a sleeve that is resiliently deformable and that is not required to provide structural rigidity to the end knob of the bat, one obtains improved damping of shock and vibrations that are transmitted to the end knob when the bat is impacted. In addition, such a resiliently deformable sleeve provides a surface having improved gripping characteristics and helps to protect the end knob from being damaged during use. By providing a sleeve that is sufficiently resilient to allow it to be stretchably placed in position over the end knob of the bat, it can be used for bats of solid wooden construction, hollow construction or any other suitable construction and can be quickly and easily placed on the bat, and removed from the bat, for example when it is damaged or worn. Moreover, because the sleeve is stretchable, it can be used on bats having a variety of handle sizes and end knob sizes. By providing a sleeve having a hole extending entirely therethrough, the shock damper can be used as a means for providing a reference for a batter to choke up in gripping the ball bat.

Figure 4:
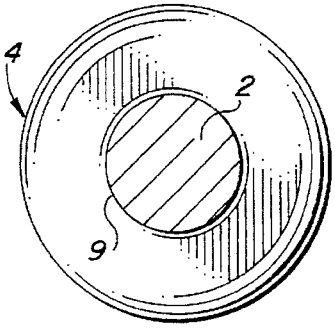
FIG. 4 is a top sectional plan view taken through line 4—4 of FIG. 2.
Figure 2:
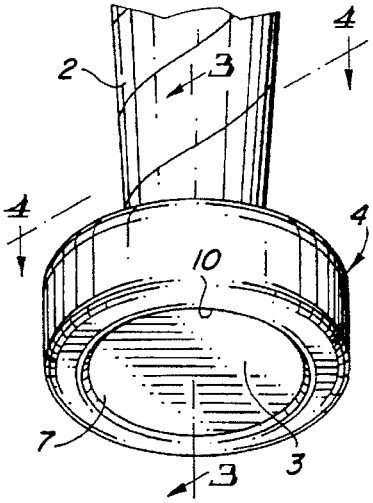
FIG. 2 is an enlarged detail view of a portion of the bat and of the sleeve shown in FIG. 1.

Referring in further detail to FIGS. 2, 3 and 4, I will describe other features of the preferred embodiment of my invention illustrated therein. The sleeve 4 has a generally cylindrical shape with a first end surface 11 and a second end surface 12. The sleeve 4 has a hole 8 extending axially through the length of the sleeve 4 and having a first opening 9 in the first end surface 11 and a second opening 10 in the second end surface 12. The hole 8 is dimensioned to closely fit around a portion of the length of handle 2 and to closely fit around the annular surface 6 of the end knob 3. The first opening 9 has a diameter to closely fit around the handle 2. The second opening 10 in the second end surface 7 has a diameter smaller than that of end knob 3 to form an inwardly directed flange 13 around the periphery of the second opening 10. The flange 13 serves to help restrict the sleeve 4 from inadvertently sliding off the end knob 3 towards the bat handle 2.

Still referring to the embodiment of FIGS. 2, 3 and 4, the sleeve 4 is preferably formed by injection molding a KRATON-based elastomer, such as that sold by G.L.S. Corporation in Cary, Ill., under the DYNAFLEX tradename as number G6713-0000, into the shape illustrated. This material can be readily molded to have a hardness in the range of 20 to 30 on the Shore A scale and provides excellent damping characteristics. It is sufficiently resilient for one to stretch it by hand in order to position it on the bat, as shown FIGS. 3 and 6, with relative ease. Also, this preferred material provides a molded surface having excellent gripping characteristics. The material may be molded to have a dimpled or otherwise textured surface to further improve gripping characteristics. It is washable and can be molded in a variety of colors, which my be selected to match an exposed decorative and/or protective bat finish, to match a team color, for identification of a bat or for other reasons. In this preferred embodiment, the thickness of the portion of the sleeve 4 adjacent to the first opening 9 is preferably about ¼", but it can be thinner, for example 1/16". The diameter of the hole 8 is between about ¾" and 1" at the first opening 9 and about 1¾" at the second opening 10. At its widest point, the diameter of the hole 8 is about 2". The sleeve 4 has a diameter of about 2¼" and a length of about ⅞".

Those skilled in the art to which this invention pertains will conceive of other embodiments of the invention which may be drawn from this disclosure. For example, the sleeve may be provided in a wide variety of shapes and can be used on implements other than ball bats, such as on tennis racquets or other similar implements having a handle and an enlarged end knob. To the extent that such other embodiments are so drawn, it is intended that they shall fall within the ambit of protection provided by the claims herein.

I claim:

1. A shock damper for a ball bat, which bat includes a handle having a handle diameter and terminating in an enlarged end knob having an end knob diameter, the shock damper comprising:

a first resiliently-deformable, generally cylindrical sleeve disposed about a longitudinal axis, the first sleeve having a first end having a first substantially circular opening, a second end having a second substantially circular opening and an interior hole extending longitudinally through the length of the sleeve between the first opening and the second opening;

the first opening having a diameter approximately equal to the bat handle diameter;

the hole having a diameter substantially equal to the end knob diameter;

the second opening having a diameter smaller than the end knob diameter but at least about as large as the bat handle diameter;

the first end including a substantially flat surface perpendicular to the longitudinal axis for resting a heel of a hand when the bat is gripped during use;

the second end having a substantially flat surface perpendicular to the longitudinal axis for contacting the first end flat surface of a second sleeve of the same design as the first sleeve when the first sleeve is stacked on the second longitudinally; and the first sleeve being compressible for dampening vibrations transmitted through the end knob, being sufficiently stretchable to slide over the end knob and onto the bat handle past the end knob, and being elastic for retaining its original shape.

2. The shock damper of claim 1 wherein the first sleeve comprises a material selected from the group consisting of polyvinylchloride and an elastomer manufactured from a styrene-ethelyne/butylene-styrene block copolymer.

3. The shock damper of claim 1 wherein the first sleeve comprises a material having a hardness of from 20 to 30 on the Shore A scale.

4. A ball bat with shock damper comprising:

a bat body having a generally cylindrical handle having a handle diameter and terminating in an enlarged end knob having an end knob diameter; and a first resiliently-deformable, generally cylindrical sleeve disposed on the end knob about a longitudinal axis, the first sleeve having a first end having a first substantially circular opening, a second end having a second substantially circular opening, and an interior hole extending longitudinally through the length of the sleeve between the first opening and the second opening;

the first opening having a diameter approximately equal to the bat handle diameter;

the hole having a diameter substantially equal to the end knob diameter;

the second opening having a diameter smaller than the end knob diameter but at least about as large as the bat handle diameter;

the first end including a substantially flat surface perpendicular to the longitudinal axis for resting a heel of a hand when the bat is gripped during use.

5. The ball bat with shock damper of claim 4 wherein the composition of the first sleeve comprises a material selected from the group consisting of polyvinylchloride and an elastomer manufactured from a styrene-ethelyne/butylene-styrene block copolymer.

6. The ball bat with shock damper of claim 4 wherein of the first sleeve comprises a material having a hardness of from 20 to 30 on the Shore A scale.

7. A ball bat with shock damper comprising:

a bat body having a generally cylindrical handle with a handle diameter and terminating in an enlarged end knob with an end knob diameter; and one or more resiliently-deformable, generally cylindrical sleeves disposed on the handle in stacked relationship to the end knob about a longitudinal axis for providing a reference for gripping the bat handle during use;

each sleeve having a first end having a first substantially circular opening, a second end having a second substantially circular opening and an interior hole extending longitudinally through the length of the sleeve between the first opening and the second opening;

the first opening of each sleeve having a diameter approximately equal to the bat handle diameter;

the hole of each sleeve having a diameter substantially equal to the end knob diameter;

the second opening of each sleeve having a diameter smaller than the end knob diameter but at least about as large as the bat handle diameter;

the first end of each sleeve including a substantially flat surface perpendicular to the longitudinal axis for resting a heel of a hand when the bat is gripped during use;

the second end of each sleeve having a substantially flat surface perpendicular to the longitudinal axis for contacting the first end flat surface of another sleeve of the same design when a plurality of sleeves are stacked on each other longitudinally;

each sleeve being compressible for dampening vibrations transmitted through the end knob, being sufficiently stretchable to slide over the end knob and onto the bat handle past the end knob, and being elastic for retaining its original shape.

8. The ball bat with shock damper of claim 7 wherein the composition of one or more of the sleeves comprises material selected from the group consisting of polyvinylchloride and an elastomer manufactured from a styrene-ethelyne/butylene-styrene block copolymer.

9. The ball bat with shock damper of claim 7 wherein the composition of one or more of the sleeves comprises material having a hardness of from 20 to 30 on the Shore A scale.

* * * * *